United States Patent [19]

Baker

[11] 4,332,410

[45] Jun. 1, 1982

[54] RETRIEVING TOOL FOR WELL PACKER

[75] Inventor: John R. Baker, Houston, Tex.

[73] Assignee: Baker International Corporation, Orange, Calif.

[21] Appl. No.: 170,493

[22] Filed: Jul. 21, 1980

[51] Int. Cl.[3] ..... E21B 31/00

[52] U.S. Cl. ..... 294/86.18; 294/86.3; 294/86.32

[58] Field of Search ..... 294/86.18, 86.30, 86.31, 294/86.32, 86.1, 86.14, 86.15, 86.17, 86.24, 86.25, 86.28, 86.34

[56] References Cited

U.S. PATENT DOCUMENTS 3,275,368 9/1966 Plunk ..... 294/86.3

3,944,273 3/1976 Ahlstene ..... 294/86.18

*Primary Examiner*—James B. Marbert

*Attorney, Agent, or Firm*—William C. Norvell, Jr.

[57] ABSTRACT

A retrieving tool is provided for effecting the retrieval of a packer from a well and includes a locking member, such as a conventional locking collet having expandable fingers for sliding over a downwardly facing shoulder on a seal nipple secured to the top end of the packer. The locking collet is surrounded by a housing sleeve which has an upwardly facing surface therein normally positioned below the finger portions of the locking collet but being engageable therewith by upward movement applied to the housing by the pulling of the tubing string, hence retrieving the packer. In the event that for some unforeseen reason, the packer being retrieved refuses to dislodge from its engagement with the well conduit, a releasing collet mechanism is provided within the retrieving tool sleeve housing which is actuated by downward jarring forces applied thereto by a wireline actuated releasing probe to effect an axial engagement between the locking collet and the housing so that the upwardly facing shoulder on the housing is not brought into engagement with the locking fingers of the locking collet and the collet locking fingers can slide over the downwardly facing shoulder on the seal nipple of the packer, thus permitting convenient recovery of the retrieval tool upon the occurrence of such emergency conditions.

3 Claims, 4 Drawing Figures

RETRIEVING TOOL FOR WELL PACKER

BACKGROUND OF THE INVENTION

1. Field of the Invention

The invention relates to a retrieving tool for well packers which have been released from packing engagement with the well casing.

2. Description of the Prior Art

Retrieving tools for well packers are well known in the prior art, both in the form of commercially utilized apparatus and in disclosures of issued patents. When the packer to be retrieved is of the type that is fluid pressure set and released, such as described and claimed in the co-pending application of Talmadge L. Crowe, Serial No. 907,121, filed May 18, 1978, entitled "Fluid Pressure Set And Released Well Packer Apparatus", and assigned to the Assignee of this application, the retrieval of the packer is accomplished by an off-on connector which is applied to the top of the packer after a pressure release assembly is dropped into the bore of the pressure set packer and effects the release of the expanded packing and slip elements of the packer. While this mechanism has proven to be completely functional, it is somewhat expensive to manufacture and presents an operational problem in the event that the packer release assembly, for whatever unanticipated reason, does not achieve a complete release of the packer from the well casing, in which case the release of the off-on connector from the packer can be accomplished but with some difficulty.

SUMMARY OF THE INVENTION

This invention provides an improved retrieval tool for well packers which operates independently of the releasing tool for effecting the retrieval of the packer after the packer has been released from set engagement with the casing by the releasing tool.

Essentially, the invention provides a locking member, such as an annular locking collet which is concentrically mounted within a housing sleeve carried by a tubing string and is axially shiftable relative thereto. The enlarged end portions of the axially extending collet fingers are shaped to provide an upwardly facing inclined surface which cooperates with a downwardly facing, inclined surface conventionally provided on a seal nipple which is secured in upwardly projecting relationship to the top end of a packer. In the running-in position of the retrieval tool, the collet fingers can expand radially outwardly into a recess formed in the wall of the surrounding housing, hence the locking end portions of the collet fingers slide readily downwardly over the downwardly facing shoulder surface provided on the seal nipple. On reversal, however, of the movement of the housing sleeve to elevate the housing, an upwardly facing, inclined shoulder within the housing moves upwardly relative to the collet locking finger end portions and holds same against outward deflection, thereby maintaining the collet fingers in locking relationship with the seal nipple and permitting the entire packer to be lifted with the housing.

In the event that for some unforeseen reason, the packer has not been completely released from the casing, the improved retrieval tool embodying this invention can be released from the packer to enable retrieval of the tubing string without the packer. For this purpose, the improved retrievable tool incorporates a releasing collet which has a shear pin connection to an upward sleeve-like extension of the locking collet. The releasing collet may be impacted by jarring forces produced by a releasing probe with a set of jars that is dropped by wireline into the top portion of the releasing tool housing. After shearing of the shear pin by the jarring forces, the application of further jarring forces effects the gradual downward movement of the releasing collet through a ratcheting connection with the locking collet. This movement causes an internal stop ring carried by the housing to engage the ends of the releasing collet, as the housing sleeve is lifted upwardly, prior to engagement of the housing lock retaining shoulder with the end portions of the locking fingers of the locking collet. Thus, the fingers of the locking collet are free to expand radially outwardly when they contact the downwardly facing inclined shoulder on the seal nipple, and the retrieving tool may be removed from the packer.

DESCRIPTION OF THE PREFERRED EMBODIMENTS

Figure 1A:
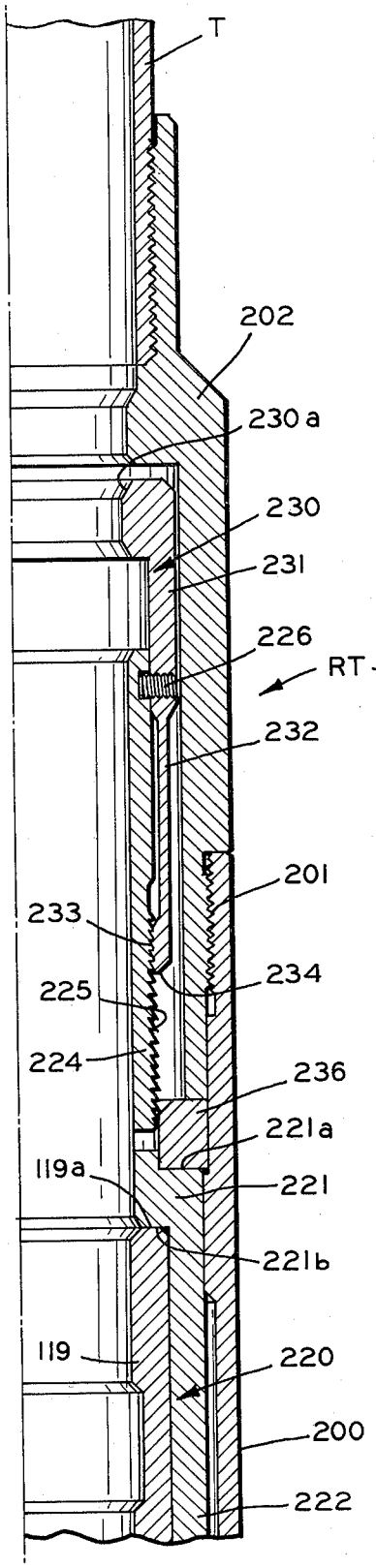
FIGS. 1*a* and 1*b* together constitute a side elevational view, partly in section, of a retrieving tool embodying this invention shown in seated relationship upon the top nipple element of a packer, FIG. 1*b* being a continuation of FIG. 1*a*.
Figure 1B:
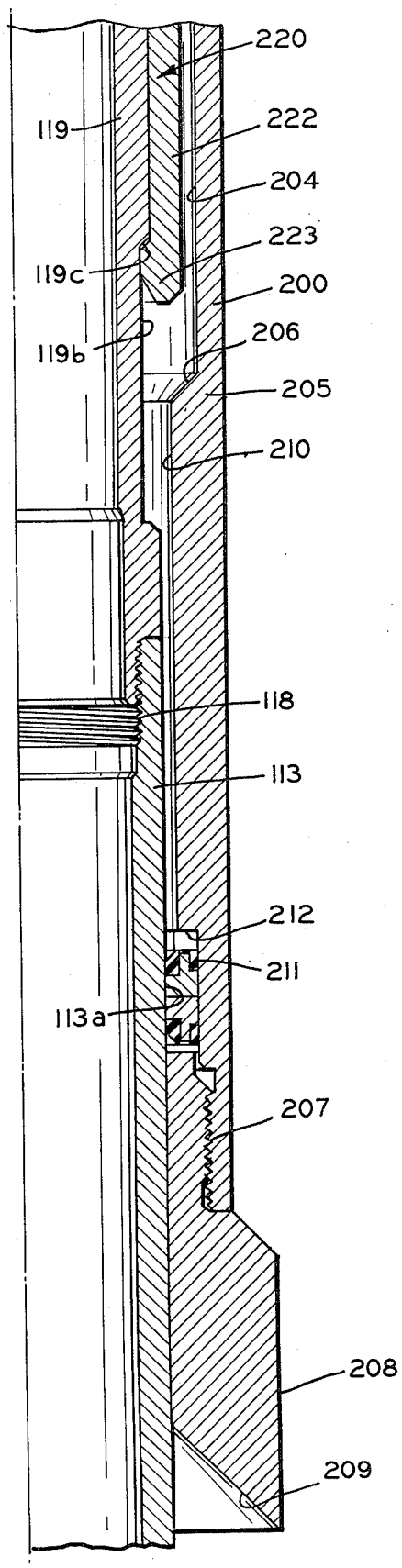

In FIG. 1*b* of the drawings, there is shown only the top end portion of an inner seal mandrel 113 which is threadably secured to an inner mandrel body (not shown) of a packer of the type described in detail in co-pending application Ser. No. 168,961, filed concurrently herewith and entitled "Hydraulically Set Well Packer". Seal mandrel 113 has its top end threadably connected as at 118 to the lower end of a seal nipple 119 having a top surface 119*a*.

The packer may however, be any type that is capable of being released from its set position. It will be assumed that the releasing mechanism for a packer has previously been actuated to apparently effect the release of the packer from packed engagement with the wall of the well casing, which is not illustrated.

The retrieval tool RT embodying this invention comprises an elongated sleeve-like housing 200 having its upper end secured as by threads 201 to a top sub 202 which is internally threaded for attachment in conventional fashion to the end of the tubing string T. The medial portion of the housing sleeve 200 is provided with an annular recess 204 which terminates at its lower end in a radially inwardly thickened portion 205 defining an upwardly facing, inclined retaining shoulder 206. The lower end of the outer housing sleeve is internally threaded as at 207 for securement to the top end of a re-entry shoe 208. The re-entry shoe 208 has a maximum diameter less than the bore of the casing or other conduit receiving the packer and has an inwardly and upwardly inclined conical bottom surface 209 which will engage the top surface 119*a* of the seal nipple 119 and center such nipple so that it will readily enter the bore 210 of the housing sleeve 200. An annular slip type seal 211 is mounted between shoulder 212 on sleeve housing portion 205 and the top end of re-entry shoe 208. Slip seal 211 engages outer surface 113*a* of seal mandrel 113.

The lower portion of the seal nipple 119 is provided with a reduced diameter external surface 119*a* which terminates at its upper end in a downwardly facing inclined locking shoulder 119*c*.

A locking collet 220 is provided within the housing sleeve 200. Such comprises an upper ring portion 221 having a plurality of peripherally spaced downwardly extending resilient fingers 222 with inwardly enlarged end portions 223 which are shaped to engage the seal nipple locking shoulder 119*c*. The upper ring portion 221 of the locking collet 200 is radially thickened in an inward direction and integrally connected to an upwardly extending sleeve portion 224 having peripheral ratchet teeth 225 formed on its outer periphery.

The top end of sleeve portion 224 is secured by a plurality of radially disposed shear screws 226 to the ring portion 231 of a releasing collet 230. The releasing collet 230 has a solid ring portion 231 at its upper end and a plurality of peripherally spaced, resilient collet fingers 232 extending downwardly therefrom and having toothed end surfaces 233 appropriately shaped to mesh with the ratchet teeth 225 provided on sleeve 224. Lastly, a stop ring 236 is mounted on housing sleeve 200 between the bottom end of the top sub 202 and the upper surface 221*a* of the locking collet ring portion 221, and functions in cooperation with lower ends 234 of fingers 232 as a stop for upward movement of the housing sleeve 200 relative to the releasing collet 230 after the shear screws 226 have been severed.

In a normal retrieval operation, the retrieving tool RT is lowered on a tubing string so that the re-entry shoe 208 slips over the top end of the seal nipple 119 which is connected to the packer. When the top end 119*a* of seal nipple 119 abuts the bottom surface 221*b* of the internally projecting portion of the locking collet ring portion 221, the enlarged finger end portions 223 of the locking collet 220 will have snapped into engagement below the locking shoulder 119*c* provided on the seal nipple 119. The tubing string T is then raised and this has the effect of moving the sleeve housing 200 upwardly relative to the locking collet 220, and hence brings the retaining shoulder 206 into engagement with the bottom ends of the locking collet fingers 222 and retains them in locked engagement with the seal nipple 119. If the packer has been successfully unpacked from its engagement with the casing, the entire packer may then be lifted from the well with the withdrawal of the tubing string T.

In some instances, for unanticipated causes, the packer may not achieve release from its packed position relative to the casing. Under these conditions, the retrieving tool RT may be manipulated solely by wireline techniques to effect the release of the releasing tool RT from the seal nipple 119.

The first step is to lower the tubing string T slightly so as to achieve the vertical separation between the retaining shoulder 206 and the locking finger end portions 222 that is shown in the drawings.

Figure 2A:
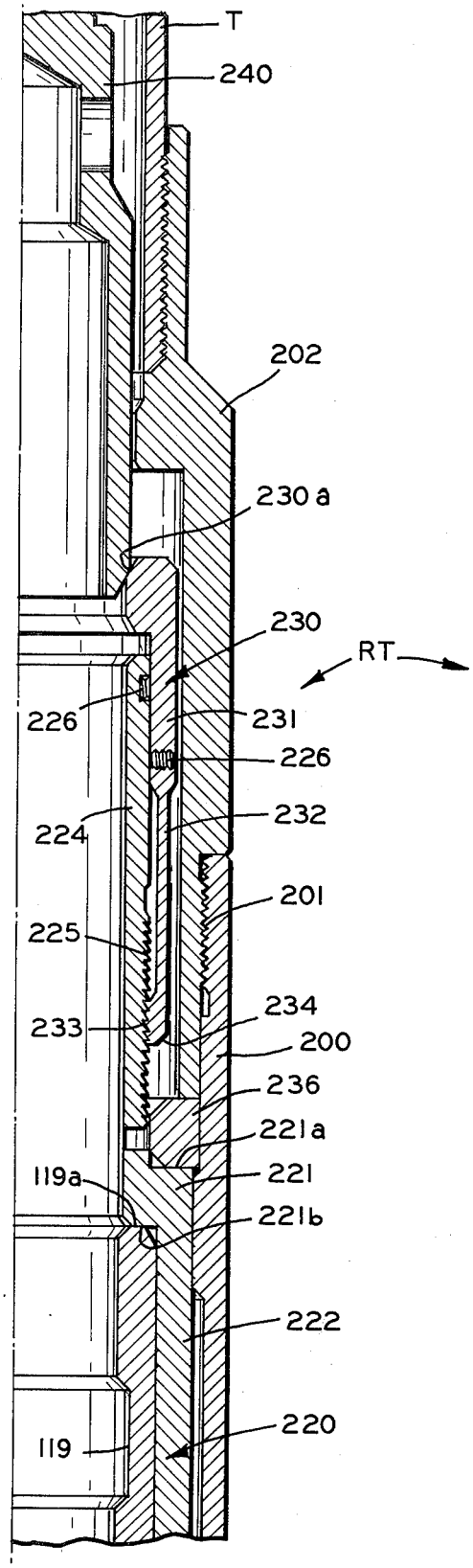
FIGS. 2*a* and 2*b* together constitute views similar to FIGS. 1*a* and 1*b*, respectively, but showing the operation of the retrieving tool when it is found that the packer cannot be pulled from the well.
Figure 2B:
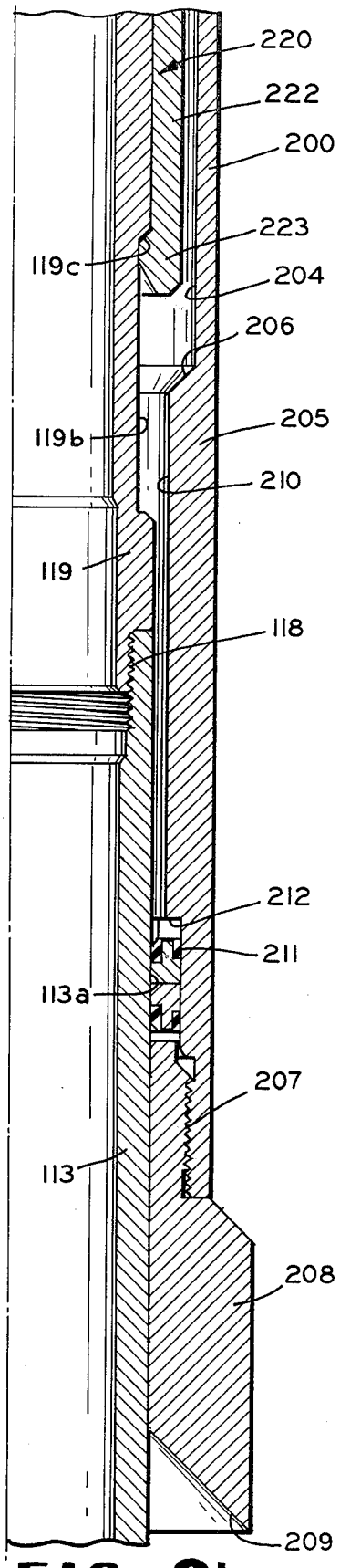

The release is then effected by dropping a releasing probe indicated schematically at 240 in FIG. 2*a* by a wireline including a set of jars until probe 240 seats on the inclined upper surface 230*a* of the releasing collet 230. The application of a downward jarring force by the releasing probe 240 upon the releasing collet 230 will first effect the shearing of the shear screws 226. Further downward jarring forces will then effect the sequential lowering of the releasing collet 230 relative to the sleeve portion 224 of the locking collet 220 by downward advancement of the fingers 232 of the releasing collet along the ratchet surfaces 225 of the sleeve 224.

The releasing collet fingers 232 are moved downwardly along the ratchets 225 until the vertical distance between the ends 234 of such fingers and the upper surface of the stop ring 236 is less than the vertical distance between the retaining sholder 206 and the lower surfaces of the collet finger end portions 223.

When this condition has been achieved, raising of the tubing string T will now first effect an upward movement of the sleeve housing 200 but, prior to the retaining shoulder 206 engaging the collet locking finger end portions 223, the stop ring 236 engages the ends 234 of the releasing collet fingers 232 and starts the locking collet 220 moving upwardly. Accordingly, releasing collet 230 functions as an adjustable stop member to limit upward movement of housing sleeve 200 relative to locking collet 200. Hence, the retaining shoulder 206 never contacts the collet finger end portions 223 and the locking collet fingers 222 are free to spring radially outwardly and move around the locking shoulder 119*c* provided on the seal nipple 119. Thus, the entire retrieving tool RT may be removed from the well, leaving the stuck packer behind.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A retrieving tool for a packer having an upstanding nipple with a downwardly facing, upwardly inclined shoulder comprising: a housing structure having an upper end attachable to a tubing string and a lower end dimensioned to surround the packer nipple; a locking member mounted within said housing structure for limited axial movement relative to the housing structure, said locking member having an upper ring portion and a plurality of peripherally spaced, downwardly projecting locking fingers constructed and arranged to snap radially inwardly into engagement with the nipple shoulder; an internally projecting locking shoulder on said housing structure movable upwardly by retrieving motion of the tubing string to engage said locking fingers and hold same in engagement with said nipple shoulder to apply upward force to the packer; a stop member mounted within said housing structure for limited downward movement relative to said housing structure; shearable means preventing relative movement of said housing structure and said stop member; means on the upper end of said stop member for reception of downward forces, thereby shearing said shearable means and advancing said stop member downwardly relative to said housing structure; and an internally projecting abutment in said housing structure engageable with said stop member by upward retrieval movement of the housing structure prior to engagement of said housing locking shoulder with said locking fingers, thereby permitting retrieval of the retrieving tool.

2. The retrieving tool of claim 1 wherein said stop member comprises a collet having peripherally spaced, radially deflectable fingers, and a serrated cylindrical surface within said housing structure cooperating with said radially deflectable fingers to permit only a downward ratcheting movement of the collet relative to said housing structure.

3. A retrieving tool for a packer having an upstanding nipple with a downwardly facing, upwardly inclined outer shoulder, comprising: a housing structure having an upper end attachable to a tubing string and a lower end dimensioned to surround the packer nipple; a locking member mounted within said housing structure for limited axial movement relative to the housing structure, said locking member having an upper ring portion and plurality of peripherally spaced, downwardly projecting locking fingers constructed and arranged to snap radially inwardly into engagement with the nipple shoulder; an inwardly projecting locking shoulder on said housing structure movable upwardly by retrieving motion of the tubing string to engage said locking fingers and hold same in engagement with said nipple shoulder to apply upward force to the packer, said locking member having an upwardly projecting sleeve portion of reduced diameter defining an annular chamber within said housing structure, said locking member sleeve portion having a plurality of axially spaced peripheral serrations formed on its external surface; a releasing collet having a ring portion slidably mountable in said chamber on the upper end of said locking member sleeve portion and having a plurality of peripherally spaced, downwardly projecting locking fingers constructed and arranged to effect a ratcheting engagement with said peripheral serrations; shearable means securing the ring portion of said releasing collet to said locking member sleeve portion; means connected to the ring portion of the releasing collet for reception of downward forces, thereby effecting the shearing of said shearable means and advancing said releasing collet downwardly relative to said sleeve portion of said locking member; and a stop ring in said housing, said stop ring being engageable with the lower ends of said releasing collet fingers by upward retrieval movement of the housing structure prior to engagement of said hosuing locking shoulder with said locking fingers of the locking member thereby permitting retrieval of the retrieving tool.

* * * * *